US008343700B2

(12) United States Patent
Yu et al.

(10) Patent No.: US 8,343,700 B2
(45) Date of Patent: Jan. 1, 2013

(54) IMAGING MEMBERS HAVING STRESS/STRAIN FREE LAYERS

(75) Inventors: Robert C. U. Yu, Webster, NY (US); Stephen T. Avery, Rochester, NY (US); Yuhua Tong, Webster, NY (US); Michael S. Roetker, Webster, NY (US); Jimmy E. Kelly, Rochester, NY (US); Kyle B. Tallman, Farmington, NY (US)

(73) Assignee: Xerox Corporation, Norwalk, CT (US)

( * ) Notice: Subject to any disclaimer, the term of this patent is extended or adjusted under 35 U.S.C. 154(b) by 469 days.

(21) Appl. No.: 12/762,257

(22) Filed: Apr. 16, 2010

(65) Prior Publication Data

US 2011/0256474 A1 Oct. 20, 2011

(51) Int. Cl.
*G03G 5/00* (2006.01)

(52) U.S. Cl. ..... 430/66; 430/67; 430/56; 430/58.05; 399/159

(58) Field of Classification Search ..... 430/66, 430/67, 56, 58.05; 399/159
See application file for complete search history.

(56) References Cited

U.S. PATENT DOCUMENTS 3,121,006 A 2/1964 Middleton et al.
3,820,989 A 6/1974 Rule et al.
3,837,851 A 9/1974 Shattuck et al.
3,895,944 A 7/1975 Wiedemann et al.
4,150,987 A 4/1979 Anderson et al.
4,233,384 A 11/1980 Turner et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,286,033 A 8/1981 Neyhart et al.
4,291,110 A 9/1981 Lee
4,297,426 A 10/1981 Sakai et al.
4,299,897 A 11/1981 Stolka et al.
4,306,008 A 12/1981 Pai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,439,507 A 3/1984 Pan et al.
4,587,189 A 5/1986 Hor et al.
4,664,995 A 5/1987 Horgan et al.
4,988,597 A 1/1991 Spiewak et al.
5,215,839 A 6/1993 Yu
5,244,762 A 9/1993 Spiewak et al.
5,660,961 A 8/1997 Yu
5,697,024 A 12/1997 Mishra
5,703,487 A 12/1997 Mishra
5,756,245 A 5/1998 Esteghamatian et al.
5,958,638 A 9/1999 Katayama et al.
6,008,653 A 12/1999 Popovic et al.
6,119,536 A 9/2000 Popovic et al.
6,124,514 A 9/2000 Emmrich et al.
6,150,824 A 11/2000 Mishra et al.
(Continued)

*Primary Examiner* — Mark A Chapman
(74) *Attorney, Agent, or Firm* — Pillsbury Winthrop Shaw Pittman LLP

(57) ABSTRACT

The presently disclosed embodiments relate in general to electrostatography comprising improved features in the flexible imaging member that enhance function when used in the electrostatographic imaging system. These embodiments pertain, more particularly, to a structurally simplified curl-free flexible electrostatographic imaging member belt containing a stress/strain free ground strip layer and stress/strain free imaging layer(s) to improve dynamic belt cyclic motion quality and extend service life.

22 Claims, 4 Drawing Sheets

U.S. PATENT DOCUMENTS 6,183,921 B1 2/2001 Yu et al.
6,214,514 B1 4/2001 Evans et al.
6,660,441 B2 12/2003 Yu
6,756,169 B2 6/2004 Lin et al.
6,933,089 B2 8/2005 Horgan et al.
7,018,756 B2 3/2006 Pai et al.
7,033,714 B2 4/2006 Horgan et al.
7,413,835 B2 8/2008 Lin et al.

IMAGING MEMBERS HAVING STRESS/STRAIN FREE LAYERS

BACKGROUND

The presently disclosed embodiments relate in general to electrostatography comprising improved features in the flexible imaging member that enhance function when used in the electrostatographic imaging system. These embodiments pertain, more particularly, to a structurally simplified curl-free flexible electrostatographic imaging member belt containing a stress/strain free ground strip layer to improve dynamic belt cyclic motion quality and extend service life. The present disclosure relates to all types of flexible electrophotographic imaging member belts used in electrophotography.

Electrostatographic imaging members are known in the art. Typical electrostatographic imaging members include (1) electrophotographic imaging members or photoreceptors for electrophotographic imaging systems and (2) electroreceptors such as ionographic imaging members for electrographic imaging systems. Generally, these imaging members comprise at least a supporting substrate and at least one imaging layer comprising a thermoplastic polymeric matrix material. In an electrophotographic imaging member or photoreceptor, the photoconductive imaging layer may comprise only a single photoconductive layer or multiple of layers such as a combination of a charge generating layer and one or more charge transport layer(s). In an electroreceptor, the imaging layer is a dielectric imaging layer.

Electrostatographic imaging members can have a number of distinctively different configurations. For example, they can comprise a flexible member, such as a flexible scroll or a belt containing a flexible substrate. Since typical flexible electrostatographic imaging members exhibit spontaneous upward imaging member curling after completion of solution coating the outermost exposed imaging layer, an anticurl back coating is required to be applied to back side of the flexible substrate support to counteract/balance the curl and provide the desirable imaging member flatness. Alternatively, the electrostatographic imaging members can also be a rigid member, such as those utilizing a rigid substrate support drum. For these drum imaging members, having a thick rigid cylindrical supporting substrate bearing the imaging layer(s), there is no exhibition of the curl-up problem, and thus, there is no need for an anticurl back coating layer. Consequently, these drum imaging members are not included in the scope of the present disclosure.

In the present disclosure, methodology and material compositions used for reformulations (pertaining to structurally simplified flexible electrostatographic imaging members that have virtually curl-free configuration without the need for an anticurl back coating) are detailed. The prepared imaging members having functionally improved the outermost exposed layers do provide an extended useful service-life function and the process for making and using these members as specified are equality applicable for flexible imaging members in all varieties of form. Even though the electrostagraphic imaging members of these disclosures relate to both electrophotographic imaging members (or photoreceptors) and ionographic imaging members (electroreceptors) in each respective flexible belt configuration, nonetheless, for reason of simplicity, all the disclosed embodiments detailed hereinafter are focused and represented primarily on the electrophotographic imaging members in flexible belt configuration which are for use in electrophotography.

A number of current flexible electrophotographic imaging member belts are multilayered photoreceptor belts that, in a negative charging system, comprise a substrate support, an electrically conductive layer, an optional charge blocking layer, an optional adhesive layer, a charge generating layer, a charge transport layer having a co-coated ground strip layer adjacent to the charge transport layer and at one edge of the belt, and an anticurl back coating at the opposite side of the substrate support. Since these flexible electrophotographic imaging member belts do always exhibit upward curling after completing the solution application coating process of a charge transport layer and the co-coated ground strip layer, the anticurl back coating is needed on the back side of the flexible substrate support (the side opposite from the electrically active layers) to balance/control the curl and render the imaging member belts flatness. So in the current imaging member belt design, the charge transport layer and the its adjacent ground strip layer at one edge of the photoreceptor belt are the two top outermost layers that are constantly exposed to the environment contaminants as well as the machine subsystems interactions during electrophotographic imaging and cleaning processes, while the anticurl back coating is the bottom outermost exposed layer subjected to belt support module components action under dynamic belt cycling condition.

The flexible electrophotographic imaging member belts are generally prepared in a seamed or seamless belt configuration. Flexible electrophotographic imaging member seamed belts are typically fabricated from a sheet which is cut from a web. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers therein to produce a strong fusion bonded seam.

In a typical negative charging machine design, the prepared flexible imaging member seamed belt is mounted over and encircled around a belt support module comprising numbers of belt support rollers and backer bars ready for electrophotographic imaging function. The flexible electrophotographic imaging member seamed belt is imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper. Therefore, under these normal machine operation conditions in the field, the flexible imaging member seamed belt is in dynamic fatigued cyclic motion during electrophotographic image printing processes. The top outermost exposed charge transport layer and the adjacent ground strip layer of the imaging member belt are therefore constantly in intimate mechanical interactions with various machine subsystems and components (such as for example cleaning blade, tab blade, cleaning brush on the charge transport layer and belt edge guides on the ground strip layer, etc.) and chemical exposure (such as corona effluents from charging devices) to therefore causing fatigue and degradation of these layers. As a consequence, these interactions have been seen to facilitate and exacerbate the early development of two crucial charge transport layer material failures in the belt, causing copy printout defects to premature cut short its service life prior to reaching the intended belt life target. Moreover, under the machine imaging member belt functioning conditions, the bottom outermost exposed the anticurl back coating is constantly subjected to belt support rollers and backer bars mechanical interactions which thereby promoting on-set of premature anticurl back coating wear and abrasion streaking failures.

Typical negatively-charged electrophotographic imaging members, such as the flexible photoreceptor designs, are made of multiple layers comprising a flexible supporting substrate, a conductive ground plane, a charge blocking layer, an optional adhesive layer, a charge generating layer, a charge transport layer, and a conductive ground strip layer co-coated adjacently to the charge transport layer at one edge of the imaging member. During the imaging member web extrusion co-coating process, the ground strip layer solution and the charge transport layer solution are simultaneously applied, adjacent to each other, over the charge generating layer with the ground strip layer at the edge of the imaging member web. The charge transport layer and the co-coated ground strip layers are usually the last layers, or the outermost layers, to be coated and are applied by solution co-coating coating process, then followed by drying the wet applied coating at elevated temperatures of about 120° C., and finally cooling it down to ambient room temperature of about 25° C. When a production web stock of several thousand feet of coated multilayered photoreceptor material is obtained after finishing solution co-application of the charge transport layer and ground strip layer and through drying/cooling process, upward curling of the multilayered photoreceptor is observed. This upward curling is a consequence of thermal contraction mismatch between the charge transport/ground strip layer in a typical electrophotographic imaging member device has a coefficient of thermal contraction approximately 3.7 times greater than that of the flexible substrate support, the charge transport layer/ground strip layer does therefore have a larger dimensional shrinkage than that of the substrate support as the imaging member web stock cools down to ambient room temperature, to result in tension stress/strain building-up and pull the imaging member upwardly. The exhibition of imaging member curling after completion of coating the charge transport layer/ground strip layer is due to the consequence of the heating/cooling processing step, according to the mechanism: (1) as the web stock carrying the wet applied charge transport layer/ground strip layer is dried at elevated temperature, dimensional contraction does occur when the wet charge transport layer/ground strip layer is losing the solvent due to evaporation at 120° C. elevated temperature drying, but at 120° C. the charge transport layer/ground strip layer are viscous flowing liquids after losing the solvent. Since its glass transition temperature (Tg) is at 85° C., the charge transport layer after losing of solvent will flow to re-adjust itself, release internal stress, and maintain its dimension stability; (2) as the charge transport layer now in the viscous liquid state cools down further and reaching its glass transition temperature (Tg) at 85° C., the charge transport layer instantaneously solidifies and adheres to the charge generating layer because it has then transformed itself from being a viscous liquid into a solid layer at its Tg; and (3) eventual cooling down the solid charge transport layer of the imaging member web from 85° C. down to 25° C. room ambient will then cause the charge transport layer to contract more than the substrate support since it has about 3.7 times greater thermal coefficient of dimensional contraction than that of the substrate support. This differential in dimensional contraction results in tension stress/strain built-up in the charge transport layer which therefore, at this instant, pulls the imaging member upward to exhibit curling. If unrestrained at this point, the imaging member web stock will spontaneously curl upwardly into a curl-up roll. By the similar fashion and same mechanism as described in the charge transport layer, the co-coated ground strip layer at the edge of the photoreceptor belt does also exhibit upward curling effect after solution co-coating with the charge transport layer and then through the drying/cooling processes. To offset the curling, an anticurl back coating is applied to the backside of the flexible substrate support, opposite to the side having the charge transport layer, and render the imaging member web stock with desired flatness.

Curling of an electrophotographic imaging member web is undesirable because it hinders fabrication of the web into cut sheets and subsequent welding into a belt. To provide desirable flatness, an anticurl back coating, having an equal counter curling effect but in the opposite direction to the applied imaging layer(s), is therefore applied to the reverse side of substrate support of the active imaging member web to balance/control the curl caused by the mismatch of the thermal contraction coefficient between the substrate and the charge transport layer, resulting in greater charge transport layer dimensional shrinkage/contraction than that of the substrate after the heating/cooling processes of the charge transport layer coating. Although the application of an anticurl back coating is effective to counter and remove the curl, nonetheless the prepared flat imaging member web does have charge transport layer tension build-up creating an internal strain of about 0.27% in the charge transport layer and also in the ground strip layer as well. The magnitude of this charge transport layer internal strain build-up is very undesirable, because it is additive to the induced bending strain of an imaging member belt as the belt dynamically bends and flexes over each belt support roller during dynamic fatigue belt cyclic motion under a normal machine electrophotographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, imaging member belt employing an anticurl backing coating has added total belt thickness to thereby increase charge transport layer bending strain which then exacerbates the early onset of belt cycling fatigue charge transport layer cracking failure. The cracks formed in the charge transport layer as a result of dynamic belt fatiguing are found to manifest themselves into copy print-out defects, which thereby adversely affect the image quality printout on the receiving paper.

Various belt function deficiencies have also been observed in the common anticurl back coating formulations used in a typical conventional imaging member belt, such as the anticurl back coating does not always providing satisfying dynamic imaging member belt performance result under a normal machine functioning condition; for example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the lost of its ability to fully counteract the curl as reflected in exhibition of gradual imaging member belt curling up in the field. Curling, caused by the internal strain in the charge transport layer and the ground strip layer, is undesirable during photoreceptor belt function, because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it does also cause the relatively rapid wearing away of the anticurl back coating produce debris which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image printout quality and shorten the imaging member belt functional life.

High contact friction of the anticurl back coating against machine subsystems is further seen to cause the development of electrostatic charge built-up problem. In other machines the electrostatic charge builds up due to contact friction between the anti-curl layer and the backer bars increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. Static charge built-up in anticurl back coating increases belt drive torque, in some instances, has also been found to result in absolute belt stalling. In other cases, the electrostatic charge build up can be so high as to cause sparking.

Another problem, encountered in the conventional belt photoreceptors using a bisphenol A polycarbonate anticurl back coating that are extensively cycled in precision electrophotographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process. On other occasions, the anticurl back coating wear debris accumulation on the backer bars does gradually increase the dynamic contact friction between these two interacting surfaces of anticurl back coating and backer bar, interfering with the duty cycle of the driving motor to a point where the motor eventually stalls and belt cycling prematurely ceases. Additionally, it is important to point out that electrophotographic imaging member belts prepared that required anticurl back coating to provide flatness have more than the above list of problems, they do indeed incur additional material and labor cost impact to imaging members' production process.

Thus, electrophotographic imaging member belts comprising a supporting substrate, having a conductive surface on one side, coated over with at least one photoconductive layer (such as the outermost charge transport layer) having a co-coated adjacent ground strip layer at one edge of the belt, and the application on the other side of the supporting substrate with a conventional anticurl back coating that does exhibit deficiencies which are undesirable in advanced automatic, cyclic electrophotographic imaging copiers, duplicators, and printers. While the above mentioned electrophotographic imaging member belts may be suitable or limited for their intended purposes, further improvement on these imaging member belts are needed. For example, there continues to be the need for improvements in such systems, particularly for an imaging member belt that has sufficiently flatness, superb wear resistance, nil or no wear debris, ease of belt drive, and eliminates electrostatic charge build-up problem, even in larger printing apparatuses. With many of above mentioned shortcomings and problems associated with electrophotographic imaging member belts having an anticurl back coating now understood, therefore there is a need to resolve these issues through the development of a methodology for fabricating imaging member belts that produce improve function and meet future machine imaging member belt life extension need. In the present disclosure, a charge transport layer material reformulation and a ground strip layer re-composition method and process of making a flexible photoreceptor belt free of the mentioned deficiencies have been identified and successfully demonstrated through the preparation of anticurl back coating-free photoreceptor belt. The improved curl-free photoreceptor belt, having absolute flatness in belt and cross-belt directions without the need of a conventional anticurl back coating, suppresses abrasion/wear failure, extends the charge transport layer cracking, and provides excellent dynamic belt motion quality under a normal machine functioning condition in the field will be described in detail in the following.

Relevant disclosures of flexible electrophotographic imagine member designs and their preparation method are listed below.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member."

Horgan et al., U.S. Pat. No. 4,664,995 issued on May 12, 1987, discloses an electrostatographic imaging member comprising at least one imaging layer capable of retaining an electrostatic latent image, a supporting substrate layer having an electrical conductive surface, and an electrically conductive ground strip layer adjacent the electrostographic imaging layer and in electrical contact with the electrical conductive layer, the electrical conductive ground strip layer comprising a film forming binder, conductive particles and crystalline particles dispersion in the film forming binder and a reaction product of a bi-functional chemical coupling agent with both the film forming binder and the crystalline particles. The imaging member may be employed in an electrostatographic imaging process.

Yu, U.S. Pat. No. 6,183,921 issued on Feb. 6, 2001, discloses a crack resistant and curl-free electrophotographic imaging member design which includes a charge transport layer comprising an active charge transporting polymeric tetraaryl-substituted biphenyldiamine, and a plasticizer.

Yu, U.S. Pat. No. 6,660,441, issued on Dec. 9, 2003, discloses an electrophotographic imaging member having a substrate support material which eliminates the need of an anticurl backing layer, a substrate support layer and a charge transport layer having a thermal contraction coefficient difference in the range of from about $-2\times10^{-5}/°$ C. to about $+2\times10^{-5}/°$ C., a substrate support material having a glass transition temperature (Tg) of at least 100° C., wherein the substrate support material is not susceptible to the attack from the charge transport layer coating solution solvent and wherein the substrate support material is represented by two specifically selected polyimides.

In U.S. Pat. No. 7,413,835 issued on Aug. 19, 2008, there is disclosed an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

Although the above-described electrophotographic imaging member belts comprise a flexible supporting substrate, a conductive surface on one side, coated over at least one photoconductive layer (such as the outermost charge transport layer) with a co-coated adjacent ground strip layer at one edge of the belt, and coated on the other side of the supporting substrate with an anticurl back coating have offer some degree of improvements, they still exhibit deficiencies which are undesirable in advanced automatic, cyclic electrophotographic imaging copiers, duplicators, and printers.

While the above mentioned electrophotographic imaging member belts may be suitable or limited for their intended purposes, further improvement on these imaging member belts are definitively required. For example, there continues to be the need for improvements in such systems, particularly for developing an imaging member belt that is absolutely curl-free and minimizes wear debris build-up, and enhances toner image transfer efficiency to receiving papers with improved image copy print-out quality in printing apparatuses and xerographic machines. In the present disclosure, a charge transport layer reformulation and a ground strip layer re-composition were successfully demonstrated by plasticizing both these layers through the incorporation of a specifically selected plasticizing liquid to eliminate the charge transport layer and the ground strip layer internal stress/strain build-up so that the resulting imaging member belt thus obtained exhibits nil or no upward curling without the application of an anticurl back coating. That means the prepared curl-free flexible imaging member belt of this disclosure has total flatness in either the belt or the trans-belt direction to impact dynamic belt motion quality improvement. Additional, without the need of an anticurl back coating, the disclosed imaging member belt thus prepared is also an effective production cost cutting measure.

SUMMARY

According to aspects illustrated herein, there is provided a flexible imaging member comprising a flexible imaging member comprising a flexible substrate, a charge generating layer disposed on the substrate, at least one charge transport layer disposed on the charge generating layer, and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point.

A flexible imaging member comprising a flexible substrate, a charge generating layer disposed on the substrate, at least one charge transport layer disposed on the charge generating layer; and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point, and further wherein the liquid plasticizing compound is selected from the group consisting of diethyl phthalate, diethylene glycol bis(allyl carbonate), monomeric bisphenol A carbonate, and mixtures thereof.

An image forming apparatus for forming images on a recording medium comprising (a) a flexible imaging member having a charge retentive-surface for receiving an electrostatic latent image thereon, wherein the flexible imaging member comprises a flexible substrate, a charge generating layer disposed on the substrate, at least one charge transport layer disposed on the charge generating layer, and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point, (b) a development component for applying a developer material to the charge-retentive surface to develop the electrostatic latent image to form a developed image on the charge-retentive surface, (c) a transfer component for transferring the developed image from the charge-retentive surface to a copy substrate, and (d) a fusing component for fusing the developed image to the copy substrate.

BRIEF DESCRIPTION OF THE DRAWINGS

For a better understanding of the present disclosure, reference may be had to the accompanying figures.

DETAILED DESCRIPTION

Figure 1:
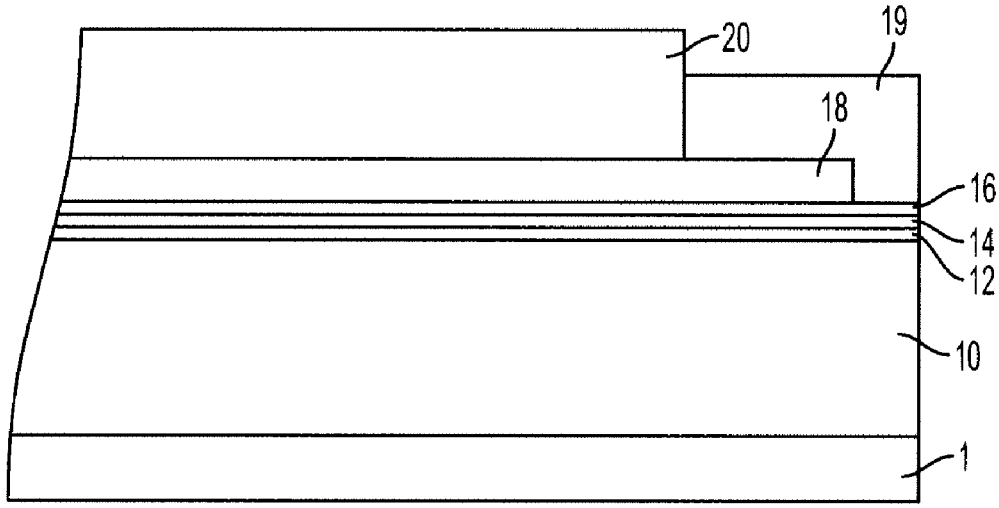
FIG. 1 is a cross-sectional view of a typical flexible multilayered electrophotographic imaging member having the configuration and structural design prepared according to the conventional description.

In the following description of curl-free imaging members preparation method, reference is made to the accompanying drawings, which form a part hereof and which illustrate several embodiments. It is understood that other embodiments may be utilized and structural and operational changes may be made without departure from the scope of the present embodiments.

According to the aspects of the present disclosure illustrated herein, there is provided a structurally simplified imaging member comprising a substrate, a charge generating layer (CGL) disposed on the substrate, and at least one charge transport layer (CTL) disposed on the CGL, and a ground strip layer co-coated with and adjacent to the CTL at one edge of the imaging member. The CTL comprises a film forming polycarbonate binder, a charge transport compound of N,N'-diphenyl-N,N'-bis(3-methylphenyl)-1,1-biphenyl-4,4'-diamine, and a plasticizing liquid compound having a high boiling point, and further wherein the liquid compound is miscible with both the polycarbonate and N,N'-diphenyl-N,N'-bis(3-methylphenyl)-1,1-biphenyl-4,4'-diamine; while the ground strip layer is comprised of film forming polymer, silica particles dispersion, and conductive species consisting of carbon black or graphite dispersion, and plus a plasticizer.

To impart the CTL and its adjacent ground strip layer with internal stress/strain relief for effecting the elimination the upward imaging member curling, both the CTL and the ground strip layer are reformulated to include the incorporation of a compatible liquid plasticizer. Plasticizers chosen to satisfy the CTL/ground strip layer internal stress/strain reduction need are divided into two categories. Namely (a) organic liquid plasticizers including phthalates, bisphenol liquids, and oligomeric styrenes and (b) fluoro-containing organic liquids which are capable of maximizing the CTL surface energy reduction effect.

Organic Liquid Plasticizers

The Organic Liquid Phthalates 26 are represented by the following:

Formula (I)

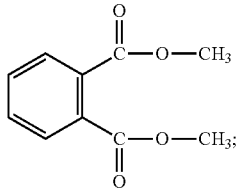

-continued

Formula (IA)

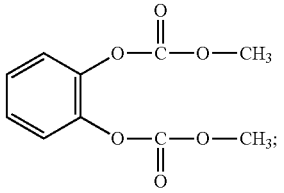

Formula (II)

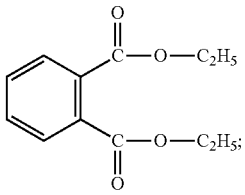

Formula (IIA)

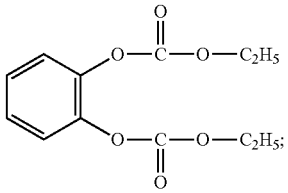

Formula (III)

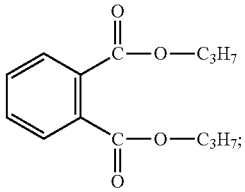

Formula (IV)

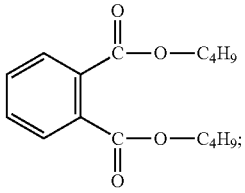

Formula (V)

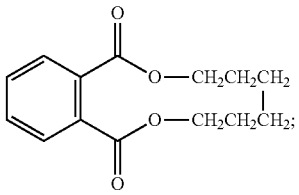

Formula (VI)

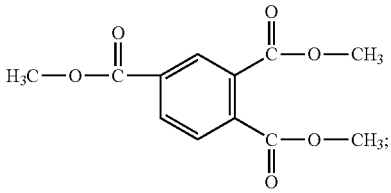

and

Formula (VII)

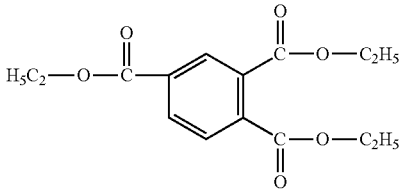

The Monomeric Carbonates Liquids as represented by the following:

Formula (1)

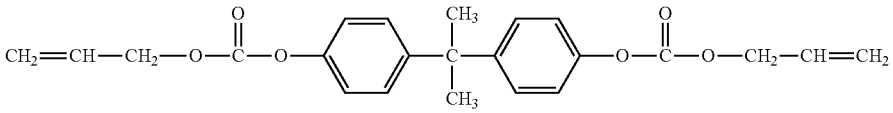

For extension of the present disclosure, alternate plasticizing carbonate liquids that are also viable for incorporation into the charge transport layer according to the present embodiments may be conveniently derived from Formula (1) to give molecular structures described in the following Formulas (2) to (5):

Formula (2)

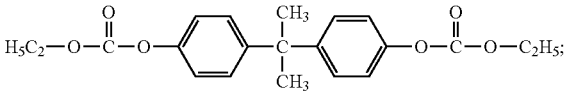

Formula (3)

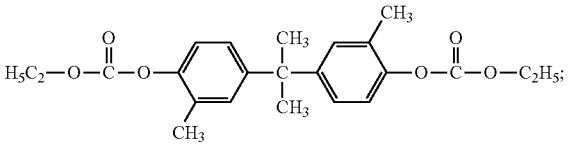

Formula (4)

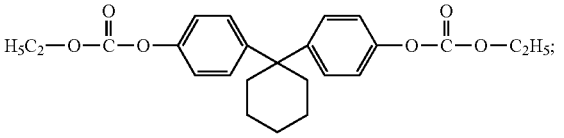

Formula (5)

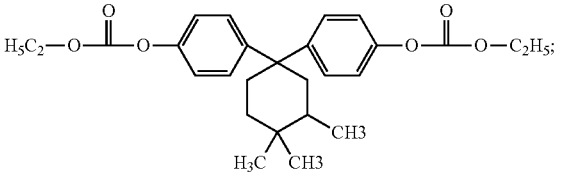

and the diethylene glycol bis(allyl carbonate) liquid of Formula (6):

Formula (6)

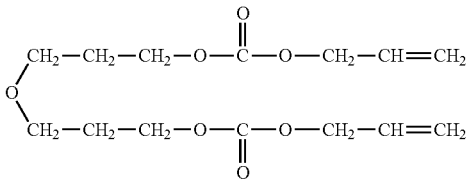

The Oligomeric Polystyrenes represented by the following:

Formula (A)

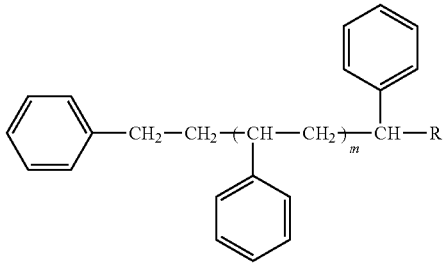

wherein R is selected from the group consisting of H, $CH_3$, $CH_2CH_3$, and $CH{=}CH_2$, and where m is between 0 and 3; and Formula (B)

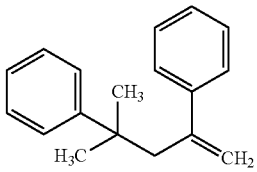

Fluoro Containing Organic Liquids 28

The fluoro-containing organic liquids 28 are to be used not only to render plasticizing effect for eliminating the CTL/ground strip layer internal stress/strain build-up for curl control, it does also provide a surface energy reduction effect to impact surface slipperiness enhancement in the resulting CTL/ground strip layer. Therefore, the fluoro-organic liquids used for CTL/ground strip layer plasticizing application are primarily selected from fluoroketones. These compounds are namely, 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl) propiophenone, 4,4,4-trifluoro-1-phenyl-1,3-butanedione, 4,4-difluoro-1-phenyl-1,3-butanedione, having the molecular structures shown below:

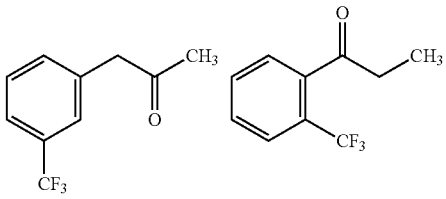

-continued

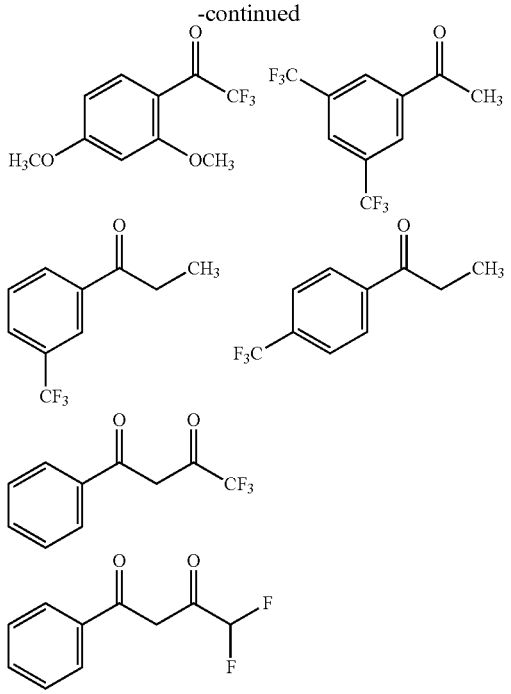

In one embodiment, there is provided a structurally simplified imaging member of this disclosure comprising a substrate, a CGL disposed on the substrate, and a CTL having the bottom layer disposed onto the CGL, and a co-coated adjacent ground strip layer to the CTL at one edge of the imaging member. The CTL comprises a film forming polycarbonate binder, a charge transport compound of N,N'-diphenyl-N,N'-bis(3-methylphenyl)-1,1'-biphenyl-4,4'-diamine, and a plasticizing liquid compound having a high boiling point, and being miscible/compatible with both the polycarbonate binder and N,N'-diphenyl-N,N'-bis(3-methylphenyl)-1,1'-biphenyl-4,4'-diamine; while the ground strip layer is comprised of film forming polycarbonate, silica particles dispersion, and conductive species consisting of carbon black or graphite dispersion, and plus a plasticizer.

In another embodiment, there is provided a structurally simplified imaging member of this disclosure comprising a substrate, a CGL disposed on the substrate, and multiple CTLs having the bottom layer disposed onto the CGL, and a co-coated adjacent ground strip layer to the CTLs at one edge of the imaging member. The multiple CTLs comprise a film forming polycarbonate binder, a charge transport compound of N,N'-diphenyl-N,N'-bis(3-methylphenyl)-1,1'-biphenyl-4,4'-diamine, and a plasticizing liquid compound having a high boiling point, and being miscible/compatible with both the polycarbonate binder and N,N'-diphenyl-N,N'-bis(3-methylphenyl)-1,1'-biphenyl-4,4'-diamine; while the ground strip layer is comprised of film forming polycarbonate, silica particles dispersion, and conductive species consisting of carbon black or graphite dispersion, and plus a plasticizer.

In a further embodiment, there is provided a structurally simplified imaging member of this disclosure comprising a substrate and a single imaging layer disposed on the substrate, wherein the single imaging layer disposed on the substrate has both charge generating and charge transporting capability and further wherein the single imaging layer comprises a polymer blended binder consisting of a low surface energy polycarbonate and a film forming polycarbonate, N,N'-diphenyl-N,N'-bis(3-methylphenyl)-1,1'-biphenyl-4,4'-diamine charge transport compound, a charge generating pigment, and a plasticizing liquid compound having a high boiling point and being miscible with both the polymer blended binder and N,N'-diphenyl-N,N'-bis(3-methylphenyl)-1,1'-biphenyl-4,4'-diamine charge transport compound. While the ground strip layer is comprised of film forming polymer, silica particles dispersion, and conductive species consisting of carbon black or graphite dispersion, and plus a plasticizer.

In summary, there is provided a structurally simplified flexible imaging member of this disclosure comprising a flexible substrate, a conductive ground plane, a hole blocking layer, a CGL, at least one CTL, and a ground strip layer co-coated with the at least one CTL and at one edge of the imaging member without the application of an ACBC disposed onto the substrate on the side opposite of the alt least one CTL. The at least one CTL (being a solid solution consisting of a film forming polycarbonate binder and a charge transporting compound) while the ground strip layer (comprising of film forming polycarbonate, silica particles dispersion, and conductive species consisting of carbon black or graphite dispersion) are both formulated to have little or nil internal build-in stress/strain through the incorporation of a suitable plasticizer.

An exemplary embodiment of a conventional negatively charged flexible electrophotographic imaging member is illustrated in FIG. 1. The flexible substrate 10 has an optional conductive layer 12. An optional hole blocking layer 14 disposed onto the conductive layer 12 is coated over with an optional adhesive layer 16. The CGL 18 is located between the adhesive layer 16 and the CTL 20. An optional ground strip layer 19 operatively connects the CGL 18 and the CTL 20 to the conductive ground plane 12. An ACBC 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An ACBC 1 may then be formed on the backside of the support substrate 1. The ACBC 1 is also solution coated, but is applied to the back side (the side opposite to all the other layers) of substrate 1, to render imaging member flatness.

The Flexible Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$/° C. to about $3\times10^{-5}$/° C. and also with a Young's Modulus of between about $5\times10^{5}$ psi ($3.5\times10^{4}$ Kg/cm2) and about $7\times10^{5}$ psi ($4.9\times10^{4}$ Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. In particular embodiments, the range is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, MYLAR or PEN having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl)gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula [H2N(CH2)4]CH3Si(OCH3)2, and (gamma-aminopropyl) methyl diethoxysilane, which has the formula [H2N(CH2)] CH33Si(OCH3)2, and combinations thereof, as disclosed, for example, in U.S. Pat. Nos. 4,338,387; 4,286,033; and 4,291,110, incorporated herein by reference in their entireties. A specific hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The CGL (e.g., charge generating) 18 may thereafter be applied to the adhesive layer 16. Any suitable CGL 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The CTL 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The CTL 20 is normally transparent in a wavelength region in which the electrophotographic imaging member is to be used when exposure is effected therethrough to ensure that most of the incident radiation is utilized by the underlying CGL 18. The CTL should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the CTL 20 need not have to be able to transmit light in the wavelength region of use for electrophotographic imaging processes if the charge CGL 18 is sandwiched between the support substrate 10 and the CTL 20. In all events, the top outermost exposed CTL 20 in conjunction with the CGL 18 is an insulator to the extent that an electrostatic charge deposited/placed over the charge transport layer is not conducted in the absence of radiant illumination. Importantly, the CTL 20 should trap minimal or no charges as the charge pass through it during the image copying/printing process.

The CTL 20 is a two components solid solution which may include any suitable charge transport component or charge activating compound useful as an additive molecularly dispersed in an electrically inactive polymeric material to form a solid solution and thereby making this material electrically active. The charge transport compound may be added to a film forming binder of polymeric material which is otherwise incapable of supporting the injection of photo generated holes from the generation material and incapable of allowing the transport of these holes there through. This converts the electrically inactive polymeric material to a material capable of supporting the injection of photogenerated holes from the CGL 18 and capable of allowing the transport of these holes through the CTL 20 in order to discharge the surface charge on the charge transport layer. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the CTL can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in CTL 20 may be, for example, at least about 5 weight % and may comprise up to about 60 weight %. The concentration or composition of the charge transport component may vary through layer 20, as disclosed, for example, in U.S. Pat. No. 7,033,714; U.S. Pat. No. 6,933,089; and U.S. Pat. No. 7,018, 756, the disclosures of which are incorporated herein by reference in their entireties.

In one exemplary embodiment, CTL 20 comprises an average of about 10 to about 60 weight percent N,N'-diphenyl-N, N'-bis(3-methylphenyl)-1,1'-biphenyl-4,4'-diamine, or from about 30 to about 50 weight percent N,N'-diphenyl-N,N'-bis (3-methylphenyl)-1,1'-biphenyl-4,4'-diamine.

The CTL 20 is an insulator to the extent that the electrostatic charge placed on the charge transport layer is not conductive in the absence of illumination at a rate sufficient to prevent formation and retention of an electrostatic latent image thereon. In general, the ratio of the thickness of the CTL 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in U.S. Pat. No. 7,018,756, which is hereby incorporated by reference.

In one specific embodiment, the CTL 20 is a solid solution including a charge transport compound, such as N,N'-diphenyl-N,N'-bis(3-methylphenyl)-1,1'-biphenyl-4,4'-diamine, molecularly dissolved in a polycarbonate binder, the binder being either a bisphenol A polycarbonate of poly(4,4'-isopropylidene diphenyl carbonate) or a poly(4,4'-diphenyl-1,1'-cyclohexane carbonate). The Bisphenol A polycarbonate used for typical charge transport layer formulation is MAKROLON which is commercially available from Farbensabricken Bayer A.G or is the FPC 0170 available from Mitsubishi Chemicals. This commercial bisphenol A polycarbonate, poly(4,4'-isopropylidene diphenyl carbonate), has a molecular weight of about 120,000 to 150,000 and a molecular structure of given in Formula (A) below:

Formula (A)

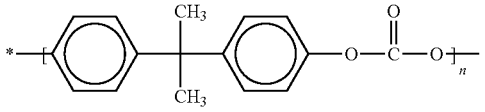

wherein n indicates the degree of polymerization. In the alternative, poly(4,4'-diphenyl-1,1'-cyclohexane carbonate) may also be used to ACBC use in place of MAKROLON or FPC 0170. The molecular structure of poly(4,4'-diphenyl-1,1'-cyclohexane carbonate), having a weight average molecular weight of about between about 20,000 and about 200,000, is given in Formula (B) below:

Formula (B)

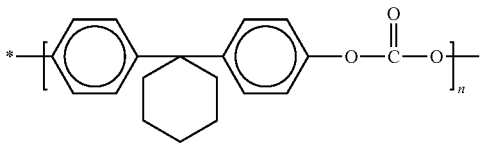

wherein n indicates the degree of polymerization.

Examples of charge transport compounds used in the CTL include, but are not limited to, triphenylmethane; bis(4-diethylamine-2-methylphenyl)phenylmethane; stilbene; hydrazone; an aromatic amine comprising tritolylamine; arylamine; enamine phenanthrene diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]-4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. Combinations of different charge compounds are also contemplated so long as they are present in an effective amount. In further embodiments, the charge transport compound is a diamine represented by the molecular structure below:

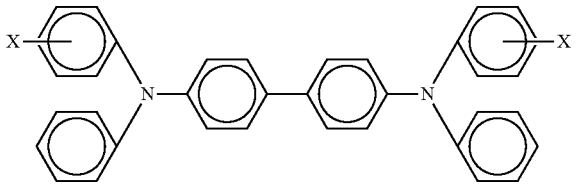

wherein X is selected from the group consisting of alkyl, hydroxy, and halogen. Such diamines are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507; these disclosures are herein incorporated in their entirety for reference.

The charge transport compound may comprise from about 10 to about 90 weight percent of the CTL, based on the total weight of the CTL. In an exemplary embodiment, the charge transport compound comprises from about 35 to about 75 weight percent or from about 60 to about 70 weight percent of the CTL for optimum function. Typically, the CTL has a thickness of from about 10 to about 40 micrometers. It may also have a Young's Modulus in the range of from about $3.0\times10^5$ psi to about $4.5\times10^5$ psi, a thermal contraction coefficient of from about $6\times10^{-5}$/° C. to about $8\times10^{-5}$/° C.

Since the CTL 20 can have a substantially greater thermal contraction coefficient constant compared to that of the flexible support substrate 10, the prepared flexible electrophotographic imaging member will typically exhibit spontaneous upward curling into a 1½ inch roll if unrestrained, after CTL application and through elevated temperature drying then cooling processes, due to the result of larger dimensional contraction in the CTL 20 than the support substrate 10, as the imaging member cools from the glass transition temperature of the CTL down to room ambient temperature of 25° C. after the heating/drying processes of the applied wet CTL coating. Therefore, a substantial internal tensile pulling strain is build-in in the CTL as it contracts more than that in the substrate after cooling down. The internal stress/strain build-in in the CTL can be expressed in equation (1) below:

$$\in=(\alpha_{CTL}-\alpha_{sub})(Tg_{CTL}-25^\circ\text{ C.}) \quad (1)$$

wherein $\in$ is the internal strain build-in in the CTL, $\alpha_{CTL}$ and $\alpha_{sub}$ are coefficient of thermal contraction of CTL and substrate respectively, and $Tg_{CTL}$ is the glass transition temperature of the CTL. Therefore, equation (1), had indicated that the key to suppress or control the imaging member upward curling is by simply decreasing the $Tg_{CTL}$ of the CTL to minimize the internal stress/strain building up and impact flatness.

However, in this conventional imaging member, an ACBC 1 is required to be applied to the back side of the support substrate 10 (which is the side opposite the side bearing the electrically active coating layers) in order to counteract the curl and render the prepared imaging member with desired flatness.

The Ground Strip Layer

The ground strip layer 19 is typically applied by solution co-coating technique, simultaneously along with CTL application, and then subjected to the same elevated temperature drying and cooling processes as described in the CTL coating above. The prepared ground strip layer does therefore contain the same internal stress/stress/strain build-up in the layer like that of the CTL 20. The conventional ground strip layer 19 including, for example, conductive particles dispersed in a film forming binder may be applied adjacent to the CTL and at one edge of the imaging member to promote electrical continuity with the conductive ground plane 12 through the hole blocking layer 14. Ground strip layer may include any suitable film forming polymer binder and electrically conductive particles. One conventional ground strip layer comprises between about 65 and about 85 weight percent of film forming polycarbonate binder, about 0.5 and about 3 weight percent ethyl cellulose, about 15 and about 25 weight percent graphite, and about 1 and about 5 weight percent silica dispersion, based on the total weight of the ground strip layer. In another conventional ground strip layer, it is comprised of about 60 to about 80 weight percent film forming polycarbonate, about 20 to about 40 weight percent carbon black, and about 1 to about 5 weight percent silica dispersion. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Anticurl Back Coating

Since the CTL 20 and the ground strip layer 19 are simultaneously applied by solution co-coating process, the applied wet films are dried at elevated temperature and then subsequently cooled down to room ambient. The resulting imaging member web if, at this point, not restrained, will spontaneously curl upwardly into a curl-up roll due to greater dimensional contraction and shrinkage of the CTL/ground strip layer than that of the substrate support layer 10. An ACBC 1, as the conventional multilayered flexible electrophotographic imaging member shown in FIG. 1, is then applied to the back side of the support substrate 10 (which is the side opposite the side bearing the electrically active coating layers) in order to render the prepared imaging member with desired flatness.

Generally, the ACBC 1 comprises a thermoplastic polymer and an adhesion promoter. The thermoplastic polymer, in some embodiments being the same as the polymer binder used in the CTL, is typically a bisphenol A polycarbonate, which along with the addition of an adhesion promoter of polyester are both dissolved in a solvent to form an ACBC solution. The coated ACBC 1 must adhere well to the support substrate 10 to prevent premature layer delamination during imaging member belt machine function in the field.

In a conventional ACBC, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent or from about 2 percent to about 10 percent by weight, based on the total weight of the ACBC. The adhesion promoter may be any known in the art, such as for example, VITEL PE2200 which is available from Bostik, Inc. (Middleton, Mass.). The ACBC has a thickness that is adequate to counteract the imaging member upward curling and provide flatness; so, it is of from about 5 micrometers to about 50 micrometers or between about 10 micrometers and about 20 micrometers. A typical, conventional ACBC formulation of the conventional imaging member of FIG. 1 does therefore have a 92:8 ratio of polycarbonate to adhesive.

Structurally Simplified Imaging Member Disclosure

Figure 2A:
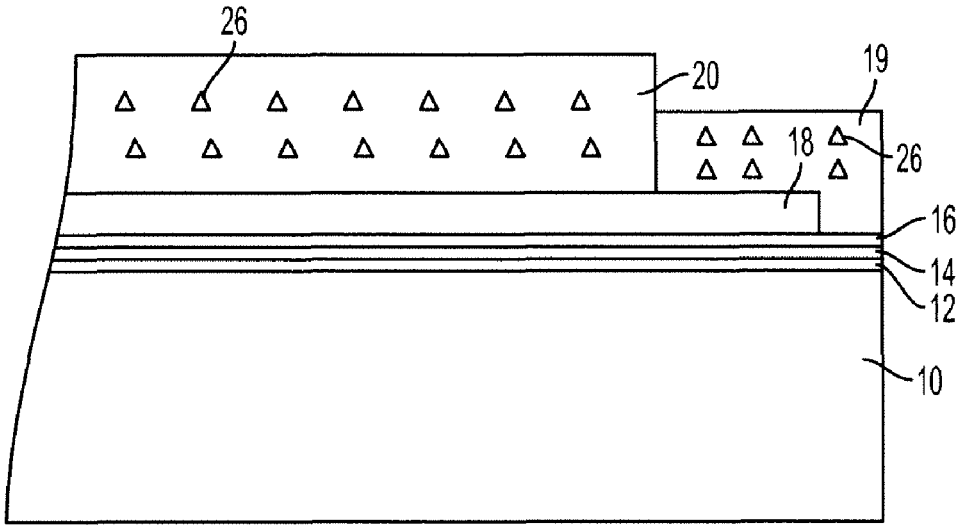
FIG. 2A is a cross-sectional view of a structurally simplified flexible multilayered electrophotographic imaging member, having a stress/strain free single charge transport layer/ground strip layer plasticized with an organic liquid 26 and without the inclusion of an anticurl back coating, according to an embodiment of the present disclosure.

FIG. 2A shows the embodiment of a structurally simplified flexible multilayered electrophotographic imaging member of this disclosure, having absolute flatness and without ACBC application, is prepared according to the material formulation and methodology of the present disclosure. In the embodiments, the substrate 10, conductive ground plane 12, hole blocking layer 14, and adhesive interface layer 16, CGL 18, CTL 20, and ground strip layer 19 of the disclosed imaging member are prepared to have very exact same materials, compositions, thicknesses, and follow the identical procedures as those described in the conventional imaging member of FIG. 1, but with the exception that both the CTL 20 and its adjacent ground stripe layer 19 are re-formulated to include an organic liquid plasticizer 26 for eliminating the internal stress/strain build-up in these layers.

The amount of organic liquid plasticizer 26 incorporated, to impact satisfactory internal stress/strain relief for imaging member curl suppression and control, is from about 3 to about 30 weight percent, based on the total weight of the CTL. But, it is preferred to be between about 5 and about 12 weight percent to impart optimum plasticizing outcome without causing without causing photoelectrical property degradation of the resulting imaging member; that is to substantially depress the Tg of the plasticized CTL, such that the magnitude of (Tg−25° C.) becomes a small value to substantially impact the CTL/ground strip layer internal strain building up reduction, according to equation (1), and provides effective imaging member curling control. The organic liquid plasticizer 26 selected for use is from one of the molecular formulas shown below.

Phthalate Plasticizers

A dimethyl phthalate chosen for imaging member CTL plasticizing use is shown in the molecular structure of Formula (1) below:

Formula (I)

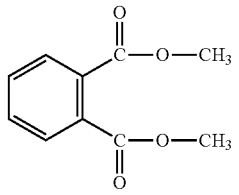

One phthalate candidate derived from Formula (1) capable for plasticizing the charge transport layer and to be included in the present disclosure is shown in the following Formula (IA):

Formula (IA)

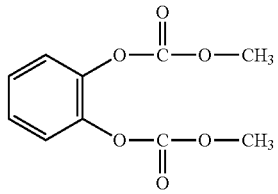

Another phthalate candidate is a diethyl phthalate that has a molecular structure of Formula (II) shown below:

Formula (II)

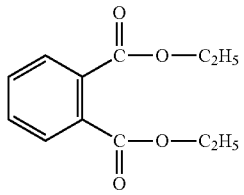

One extended phthalate candidate for the charge transport layer plasticizing derived from Formula (II) and included for present disclosure application is shown in the following Formula (IIA):

Formula (IIA)

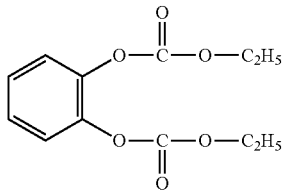

Another phthalate candidate is a dipropyl phthalate which has a molecular structure shown in Formula (III) below:

Formula (III)

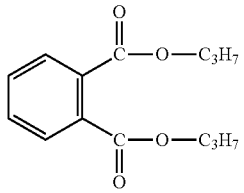

Another phthalate candidate is a dibutyl phthalate having a molecular structure formula given in the following Formula (IV):

Formula (IV)

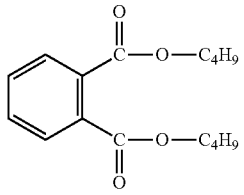

Another phthalate candidate is a hexamethylene phthalate having a particular molecular structure formula shown in Formula (V) below:

Formula (V)

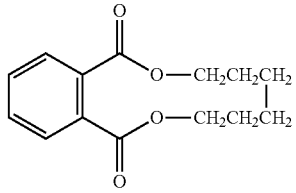

Another phthalate candidate is a trimethyl 1,2,4-benzenetricarboxylate which is described by the following molecular structure formula of Formula (VI):

Formula (VI)

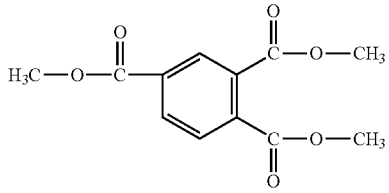

Another phthalate candidate is a triethyl 1,2,4-benzenetricarboxylate which is described according to the molecular structure formula of Formula (VII) below:

Formula (VII)

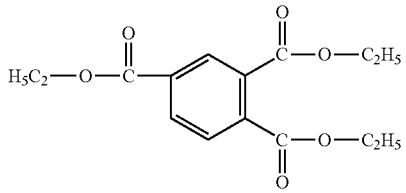

Monomeric Bisphenol Carbonate

Other plasticizing candidates may also be used for incorporation into a charge transport layer. Such candidates include an aromatic monomer of bisphenol A carbonate liquid represented by the molecular structural Formula (1) below:

Formula (1)

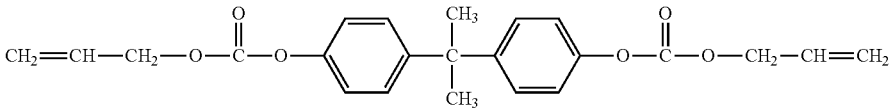

For present disclosure extension, alternate plasticizing carbonate liquids that are also viable for incorporation into the charge transport layer according to the present embodiments may be conveniently derived from Formula (1) to give molecular structures described in the following Formulas (2) to (5):

Formula (2)

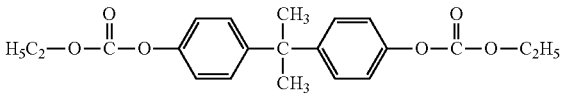

Formula (3)

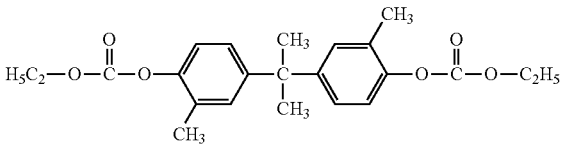

Formula (4)

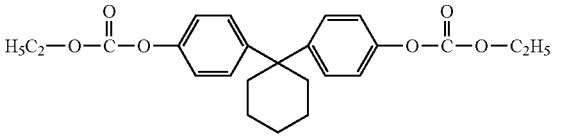

Formula (5)

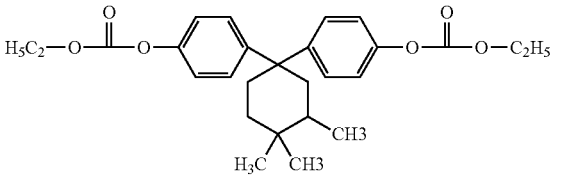

and the diethylene glycol bis(allyl carbonate) liquid of Formula (6):

Formula (6)

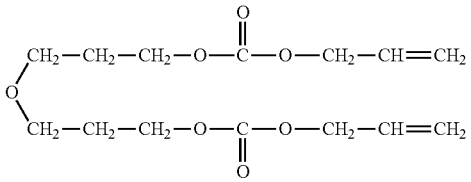

Oligomeric Polystyrenes

To provide the intended charge transport layer plasticizing result for the preparation of an anticurl back coating-free imaging member, two liquid candidates are also included for present disclosure application, which are described below.

An oligomeric polystyrene liquid chosen for charge transport layer plasticizing use has a molecular structure shown in Formula (A) below:

Formula (A)

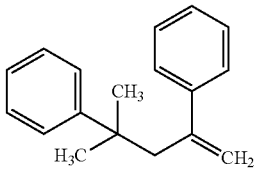

An alternate oligomeric polystyrene is a modified structure derived from Formula (A) to give a methyl styrene dimer liquid of Formula (B) shown below:

Formula (B)

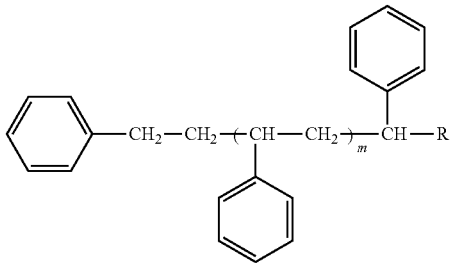

where R is selected from the group consisting of H, $CH_3$, $CH_2CH_3$, and $CH{=}CH_2$, and where m is between 0 and 3.

Figure 2B:
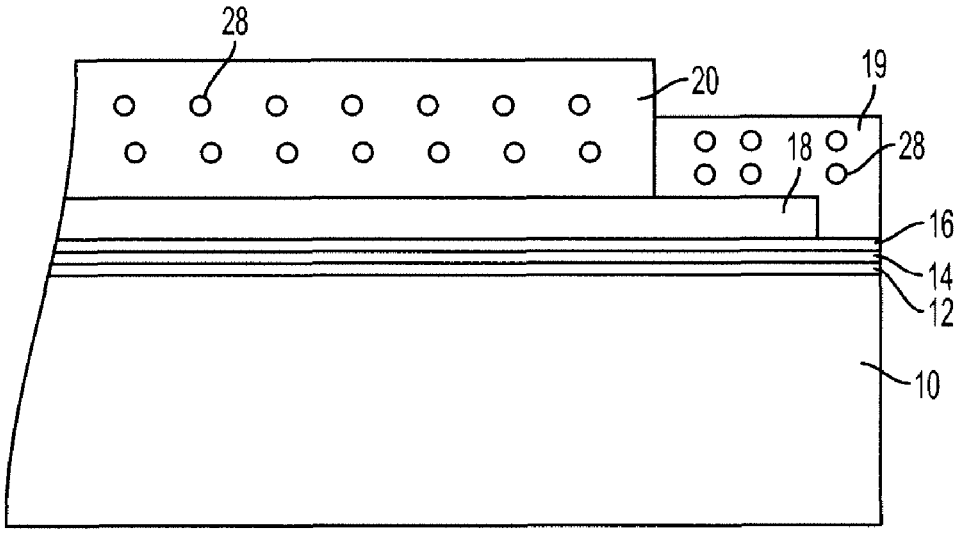
FIG. 2B is a cross-sectional view of a structurally simplified flexible multilayered electrophotographic imaging member, having a stress/strain free single charge transport layer/ground strip layer plasticized with a fluoroketone liquid 28 and without the inclusion of an anticurl back coating, according to an embodiment of the present disclosure.

In further embodiments, the preparation of a structurally simplified flexible multilayered electrophotographic multilayered electrophotographic imaging member of this disclosure, having absolute flatness and without ACBC application, is again prepared in the same fashion. In these embodiments, the substrate 10, conductive ground plane 12, hole blocking layer 14, and adhesive interface layer 16, CGL 18, CTL 20, and ground strip layer 19 of the flexible imaging member, shown in FIG. 2B, are formed by following the same steps and uses the same material compositions according to those described in above FIG. 2A, but with the exception that the organic liquid plasticizer 26 used for plasticizing the CTL 20 and its adjacent ground strip layer 19 is now replaced with a low surface energy fluoro containing organic liquid 28. Since fluoro-ketones are by themselves inherently low surface energy liquids, so each incorporation is more than producing the key plasticization effect to minimize the internal stress/strain build-up in the layers for imaging member curl control, it does also render a surface energy lowering outcome to provide the resulting CTL and ground strip layer with surface slipperiness for contact friction reduction.

The plasticizing fluoro-containing organic liquid 28 suitable for effecting CTL/ground strip layer internal stress/strain relief are preferably the fluoroketones, such as 3-(trifluoromethyl)phenylacetone, 2'-(trifluoromethyl)propiophenone; 2,2,2-trifluoro-2',4'-dimethoxyacetophenone; 3',5'-bis(trifluoromethyl)acetophenone; 3'-(trifluoromethyl)propiophenone, 4'-(trifluoromethyl)propiophenone; 4,4,4-trifluoro-1-phenyl-1,3-butanedione; and 4,4-difluoro-1-phenyl-1,3-butanedione, represented by the molecular structures shown below:

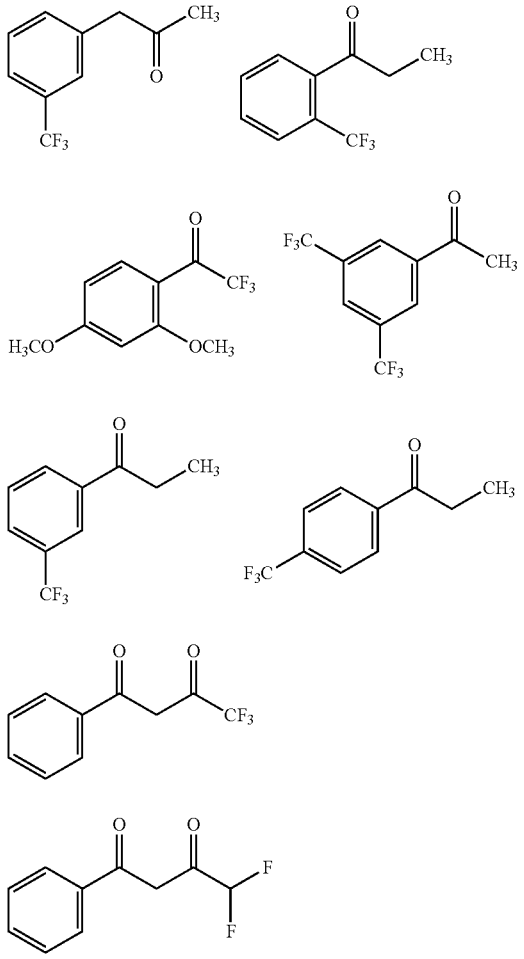

The amount of plasticizing fluoro-containing organic liquid 28 selected from one of the above for incorporation is again from about 3 to about 30 weight percent, based on the total weight of the respective CTL or the ground strip layer. Preferably, to be between about 5 and about 12 weight percent to impart optimum plasticizing outcome without causing photoelectrical property degradation of the resulting imaging member nor deleterious electrical conductivity impact of the ground strip layer.

Figure 3:
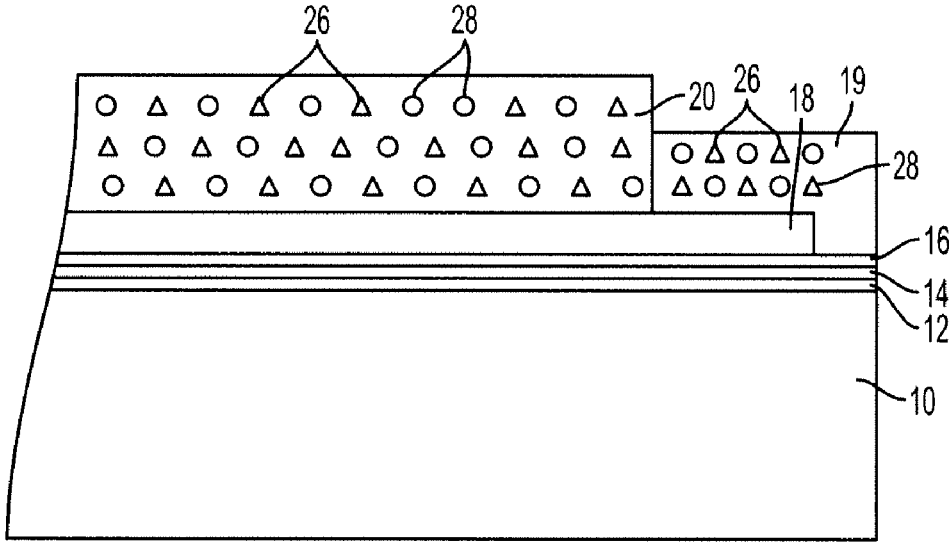
FIG. 3 is a cross-sectional view of yet another structurally simplified flexible multilayered electrophotographic imaging member, having a stress/strain free single charge transport layer/ground strip layer plasticized with a binary mixture liquids 26 and 28 without the inclusion of an anticurl back coating, according to an embodiment of the present disclosure.

In further extended embodiments, referring to FIG. 3, the structurally simplified flexible multilayered electrophotographic imaging member of this disclosure is prepared again to have a plasticized single CTL 20 and plasticized ground strip layer 19 in accordance to those disclosed in the embodiments of FIGS. 2A and 2B, but with the exception that the use of single component plasticizer, being of either an organic liquid plasticizer 26 or a fluoro containing ketone 28 incorporated in the CTL 20 and ground strip layer, has been alternatively replaced with a binary mixture of equal parts of two plasticizers 26 and 28 in every possible mixing combination. That means the binary plasticizer mixture is formed by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones. The total amount of the two plasticizer mixture present in the single CTL/ground strip layer of the prepared imaging member, shown in FIG. 3, is in a range of from about 3 to about 30 weight percent or between about 5 and about 12 weight percent based on the total weight of each respective resulting layer. The weight ratios of organic liquid 26 to fluoroketone 28 in the plasticizer mixture is between about 10:90 and about 90:10. Therefore, the use of binary plasticizer mixture in the CTL and the ground strip should provide the option of being able to adjust or tune the slipperiness of the surface of both these layers at will to meet any specific xerographic machine's need.

Figure 4:
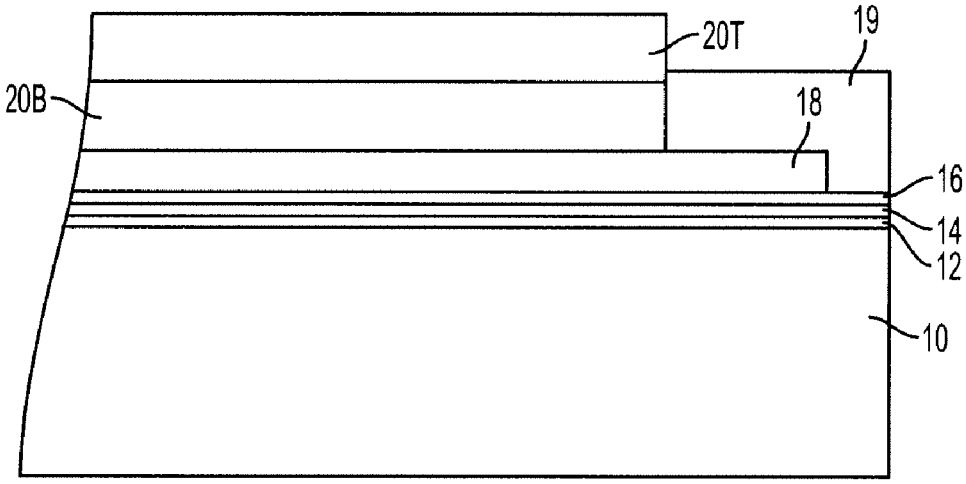
FIG. 4 is a cross-sectional view of a structurally simplified flexible multilayered electrophotographic imaging member having stress/strain free dual charge transport layers/ground strip layer and without the inclusion of an anticurl back coating according to an embodiment of the present disclosure.

In still another further extension of embodiments, the structurally simplified flexible multilayered electrophotographic imaging member of this disclosure, shown in FIG. 4, is prepared such that the CTL 20 is a re-designed one that gives plasticized dual layers, consisting of a bottom layer 20B and a top exposed layer 20T, and incorporated into these dual layers and the adjacent ground strip layer with an organic plasticizing liquid 26. Both plasticized dual CTLs are about the same thickness, comprise the same combination of diamine m-TBD and polycarbonate binder; that means both layers are comprised of about 30 to about 70 weight percent of N,N'-diphenyl-N,N'-bis(3-methylphenyl)-1,1'-biphenyl-4,4'-diamine (mTBD) charge transporting compound, about 70 to about 30 weight percent of polycarbonate binder which is corresponding to comprise of about 30 to about 70 weight percent of N,N'-diphenyl-N,N'-bis(3-methylphenyl)-1,1'-biphenyl-4,4'-diamine (mTBD) charge transporting compound, about 70 to about 30 weight percent of polycarbonate binder. The amount of organic liquid plasticizer 26 incorporated into each of the dual layers and the ground strip layer is the same; that is from about 3 to about 30 weight percent or between about 5 and about 12 weight percent with respect to the total weight of each respective layer. In the modification of these very exact same embodiments, the organic liquid 26 plasticized dual CTLs are further re-formulated such that the bottom layer 20B contains greater amount of diamine m-TBD than that in the top exposed layer 20T for preserving the photoelectrical integrity and impact best mechanical function of the imaging member. Therefore, the bottom layer 20B is comprised of about 40 to about 70 weight percent diamine m-TBD while the top layer 20T comprises about 20 to about 60 weight percent diamine m-TBD based on the combined weight of diamine m-TBD and polycarbonate binder of the respective layer. In the extension of all these very exact same embodiments of FIG. 4, the plasticizing liquid for incorporation into both dual CTLs and the adjacent ground strip layer of all the prepared imaging members is selected from a fluoro-containing organic liquid 28.

In yet another extension embodiments of the very exact same structurally simplified flexible multilayered electrophotographic imaging members of FIG. 4 disclosures, both these dual CTLs and the adjacent ground strip layer are plasticized by using the binary mixture plasticizers of equal parts of 26 and 28. Although both of these layers are designed to comprise about the same thickness, the same diamine m-TBD and polycarbonate binder, and the same amount of binary plasticizer liquid mixture incorporation of from about 3 to about 30 weight percent or between about 5 and about 12 weight percent with respect to the total weight of each respective layer, however the bottom layer 20B contains larger amount of diamine m-TBD than that in the top layer 20T; that means the bottom layer is comprised of about 40 to about 70 weight percent diamine m-TBD while the slippery top outermost layer comprises about 20 to about 60 weight percent diamine m-TBD to maintain photoelectrical integrity and enhance the mechanical performance.

Figure 5:
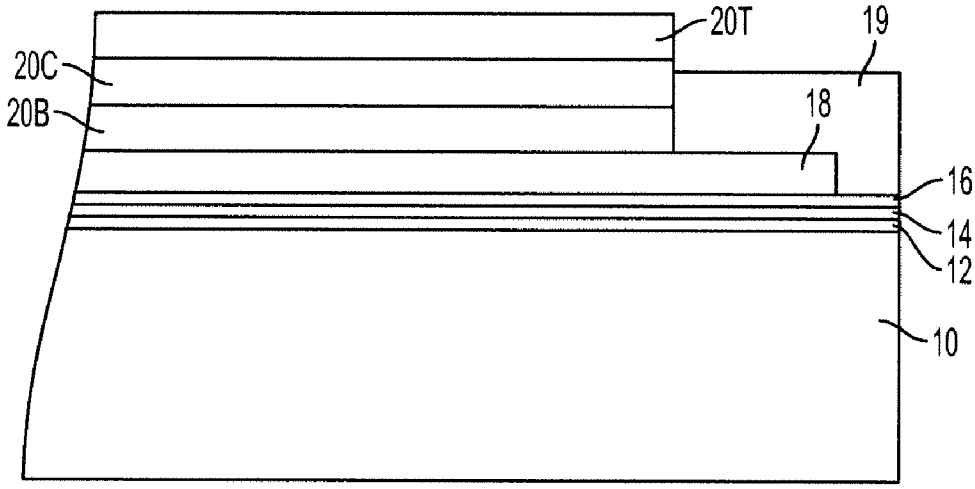
FIG. 5 is a cross-sectional view of a structurally simplified flexible multilayered electrophotographic imaging member, having stress/strain free triple charge transport layers/ground strip layer and without the inclusion of an anticurl back coating, according to an embodiment of the present disclosure.

In the additional extended embodiments, the plasticized CTL in the structurally simplified flexible multilayered electrophotographic imaging member of this disclosure, as shown in FIG. 5, is another further re-design that gives triple layers: a bottom layer 20B, a center layer 20C, and a top outermost exposed layer 20T; wherein all the three CTLs are comprised of about the same thickness, the same diamine m-TBD and polycarbonate binder composition matrix. In these embodiments, all the triple CTLs and the adjacent ground strip layer are plasticized with the same amount of organic liquid 26 from about 3 to about 30 weight percent or between about 5 and about 12 weight percent with respect to the total weight of each respective layer. In the extension of these same additional extended embodiments, the plasticizer selected for all the triple CTLs incorporation is a fluoroketone 28. In the alternative of these additional extended embodiments, the plasticized triple CTLs in the structurally simplified flexible imaging member of this disclosure are re-formulated such that all the structural dimensions and material compositions of all these CTLs are maintained identically to what already described, but with the exception that the single component plasticizer present in these triple layers and the adjacent ground strip layer is alternatively replaced with a mixture of equal parts of the two different plasticizers 26 and 28. The binary plasticizer mixture is formed to give every possible variety of compositions; that is for example, by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones.

In the ultimate extension of all these very same extended embodiments of the preceding structurally simplified flexible multilayered electrophotographic imaging member of this disclosure shown in FIG. 5, the formulations of these plasticized triple CTLs (comprising about the same thickness, the same diamine m-TBD and polycarbonate binder composition matrix, the exact same amount of plasticizer addition of from about 3 to about 30 weight percent or between about 5 and about 12 weight percent with respect to the total weight of each respective layer) are further altered and modified to comprise different amount of diamine m-TBD content, in descending order from bottom to the top layer, such that the bottom layer 20B has about 50 to about 80 weight percent, the center layer 20C has about 40 and about 70 weight percent, and the top outermost exposed layer 20T has about 20 and about 60 weight percent diamine m-TBD to maintain photoelectrical integrity as well as improve the mechanical function.

Figure 6:
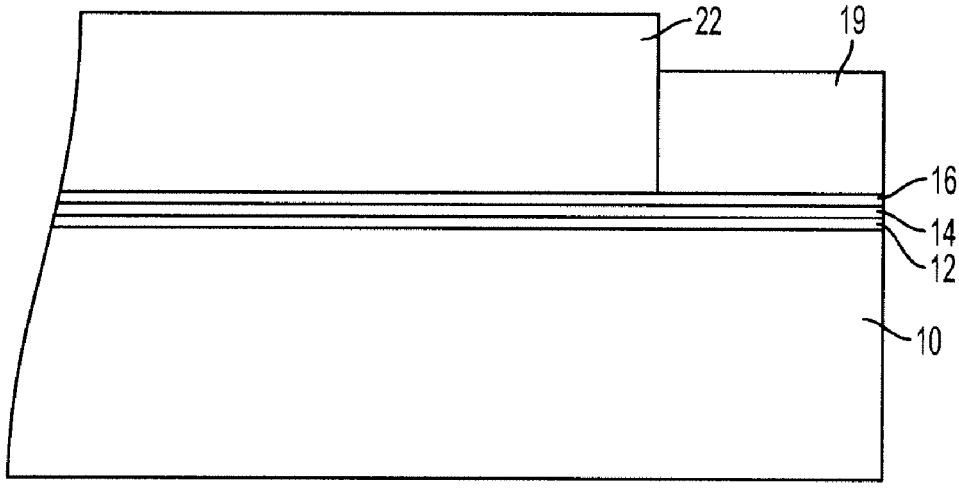
FIG. 6 is a cross-sectional view of a structurally simplified flexible multilayered electrophotographic imaging member, having a stress/strain free single charge generating-transporting layer/ground strip layer and no application of an anticurl back coating, according to an alternative embodiment of the present disclosure.

As an alternative to the two discretely separated layers of being a CTL 20 and a CGL 18 as those shown in FIGS. 1, 2A, 2B, 3, 4, and 5 above, a structurally simplified flexible multilayered electrophotographic imaging member of this disclosure is created according to the illustration in FIG. 6. Although all other layers are being formed in the exact same manners and compositions like in the preceding figures, a single imaging layer 22 having both charge generating and charge transporting capabilities is utilized and also being plasticized along with its adjacent ground strip layer 19, by using the present disclosed plasticizers to reduce the internal stress/strain build-up for curl control without the need for an ACBC. As disclosed in the prior references, for example in U.S. Pat. No. 6,756,169, the single imaging layer 22 may comprise a single electrophotographically active layer capable of retaining an electrostatic charge in the dark during electrostatic charging, imagewise exposure, and image development. Nevertheless, the plasticized single imaging layer 22 of present disclosure may be formed to include charge transport molecules (the same to those of the CTL 20 according to the description in the preceding), may also optionally include a photogenerating/photoconductive material similar to those of the CGL 18 described above, plus the inclusion of a plasticizer. In exemplary embodiments, the single imaging layer 22 along with its adjacent ground strip layer 19 in the structurally simplified flexible imaging member of this disclosure are both plasticized by using a single plasticizer liquid 26 which is selected from one of Formulas (IA), (IIA), (III), (IV), (V), (VI), (VII), (1), (2), (3), (4), (5), (6), (A), and (B) for internal stress/strain relief and curl elimination. The amount of the single component plasticizer incorporation into the layer is from about 3 to about 30 weight percent or between about 5 and about 12 weight percent with respect to the total weight of the single layer 22 and the ground strip layer 19.

In another exemplary embodiments of FIG. 6, the single imaging layer 22 and the ground strip layer 19 of the structurally simplified flexible multilayered electrophotographic imaging member of this disclosure are both plasticized with a fluoroketone liquid 28 selected from each of the eight listed fluoroketones to render the surface slipperiness effect.

In yet another exemplary embodiments, the plasticized single imaging layer 22 and the ground strip layer 19 of the structurally simplified flexible imaging member of this disclosure are plasticized with the use of a plasticizer mixture consisting of equal parts of the two different plasticizer categories. That is the binary plasticizer mixture is formed to give every possible variety of compositions, for example, by mixing each liquid 26 of Formulas (IA), (IIA), (III), (IV), (V), (VI), (VII), (1), (2), (3), (4), (5), (6), (A), and (B) with a liquid 28 selected from each of the eight fluoroketones. The weight ratios of organic liquid 26 to fluoroketone 28 in the plasticizer mixture is between about 10:90 and about 90:10. The amount of the binary plasticizers mixture incorporated into each layer is from about 3 to about 30 weight percent or between about 5 and about 12 weight percent with respect to the total weight of the single layer 22 and the ground strip layer 19.

It is important to emphasize that the selection of organic phthalates, monomeric carbonates, and fluoro-containing organic liquids, for use as a single plasticizer or a binary mixture of plasticizers incorporation in all the preceding structurally simplified flexible imaging member preparation embodiments to meet plasticization and curl control requirement, is based on the facts that these plasticizers are (a) each a high boiling compound with boiling point of at least 250° C. so their presence in the CTL(s) and ground strip layer does effect a permanent plasticizing result and (b) they are totally miscible/compatible with the make-up compositions of the CTL(s) and the ground strip layer in a manner that the incorporation into the respective CTL/ground strip layer material matrix does not cause deleterious degradation to the photoelectrical function of the resulting imaging member.

In general, the thickness of the plasticized CTL(s) (being a plasticized single layer, dual layers, or triple layers) in all the structurally simplified flexible multilayered electrophotographic imaging member of this disclosure, is (are) prepared according to FIGS. 2 to 6 disclosed above, and is in the range of from about 10 to about 100 micrometers, or between about 15 and about 50 micrometers. It is important to emphasize that the reasons the top outermost top layer of these imaging members employing compounded CTLs in the disclosure embodiments is formulated to comprise the least amount of diamine m-TBD charge transport molecules (in the descending concentration gradient from the bottom layer up to the top exposed layer) are to: (1) inhibit diamine m-TBD crystallization at the interface between two coating layers, (2) also to enhance the top layer's fatigue cracking resistance during dynamic machine belt cyclic function in the field, and (3) still yet able to maintain the desirably good photoelectrical properties to assure the resulting anticurl back coating-free imaging member belts properly function in the field.

The structurally simplified flexible multilayered electrophotographic imaging member of this disclosure, prepared to contain plasticized CTL(s) and a adjacent plasticized ground strip layer to one edge of the imaging member without the application of an ACBC, should have preserved the photoelectrical integrity and ground strip layer electrical conductivity with respect to each control imaging member counterpart. That means having charge acceptance ($V_0$) in a range of from about 750 to about 850 volts; sensitivity (S) sensitivity from about 250 to about 450 volts/ergs/cm$^2$; residual potential ($V_r$) less than about 50 volts; dark development potential (Vddp) of between about 280 and about 620 volts; and dark decay voltage (Vdd) of between about 50 and about 20 volts, and a ground strip layer resistivity (reversal of conductivity) less than 35,000 ohms/sq (Ω/sq.).

For typical conventional ionographic imaging members used in an electrographic system, an electrically insulating dielectric imaging layer is applied to the electrically conductive surface. The substrate also contains an ACBC on the side opposite from the side bearing the electrically active layer to maintain imaging member flatness. In the present disclosure embodiments, the structurally simplified flexible ionographic imaging member of this disclosure may also conveniently be prepared without the need for an ACBC, through incorporating the dielectric imaging layer and the ground strip layer with the use of plasticizer(s) incorporation according to the very same manners and descriptions demonstrated in the structurally simplified flexible electrophotographic imaging members preparation disclosure above.

To further improved the mechanical performance of the structurally simplified flexible multilayered electrophotographic imaging member design of this disclosure, the plasticized ground strip layer, the top CTL or the single CTL may also include an additive of inorganic or organic fillers to impart and/or enhance greater wear resistance. Inorganic fillers may include, but are not limited to, silica, metal oxides, metal carbonate, metal silicates, and the like, and mixtures thereof. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement. The top CTL may also contain a light shock resisting or reducing agent of from about 1 to about 6 wt-%. Such light shock resisting agents include 3,3',5,5'-tetra(t-butyl)-4,4'-diphenoquinone (DPQ); 5,6,11,12-tetraphenyl naphthacene (Rubrene); 2,2'-[cyclohexylidenebis[(2-methyl-4,1-phenylene)azo]]bis[4-cyclohexyl-(9Cl)]; perinones; perylenes; and dibromo anthanthrone (DBA).

The structurally simplified flexible multilayered electrophotographic imaging member, thus fabricated in accordance to all the above mentioned embodiments of present disclosure, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared structurally simplified flexible multilayered electrophotographic imaging member belt of this disclosure may thus thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared structurally simplified flexible multilayered electrophotographic imaging member belt of present disclosure can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on a slippery surface and curl-free flexible imaging member, developing a latent image, and transferring the developed electrostatic image to a suitable receiving substrate.

The development of the presently disclosed embodiments will further be demonstrated in the non-limiting Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

EXAMPLES

Control Ground Strip Layer I

Ten 9 inch×11 inch rectangular sheets of 4.2-mil thick biaxially oriented polyethylene naphthalate (PEN, available as KADALEX from DuPont Teijin Films), having a 0.02 micrometer thick titanium surface layer, were each coated onto with a 0.04 micrometer thick dried/cured gamma aminopropyltriethoxy silane coating and subsequently applied over to give 0.02 micrometer ARDEL polyarylate adhesive interface layer. The four PEN substrates (having these coatings) thus obtained were to be used as the substrate supports for demonstration ground strip layer samples preparation in each of the following working examples.

A conventional ground strip layer coating solution was prepared by combing 10.5 grams of bisphenol A polycarbonate (FPC 0170, having a molecular weight of about 120,000 and commercially available from Mitsubishi Chemicals), 1.20 grams ethyl cellulose, 3.92 grams graphite dispersion, and 0.45 gram silica particles in 183 grams methylene chloride solvent. The coating solution was then applied over one of the above mentioned 4.2-mil PEN substrate support, by following the standard hand coating procedures and dried at 130° C. in an air circulating oven for 2 minutes, to give a 18 micrometers dry thickness first group strip layer control sample. If unrestrained, the prepared ground strip layer sample will spontaneously curl upwardly into a 1¾ inch roll.

Control Ground Strip Layer II

Another conventional ground strip layer coating solution was also prepared by combing 30.56 grams of bisphenol A polycarbonate (FPC 0170), 12 grams XEDAG/KB carbon black, and 1.4 gram silica particles in 416 grams methylene chloride solvent. The coating solution was then applied over second 4.2-mil PEN substrate support, by following the standard hand coating procedures and dried at 130° C. in an air circulating oven for 2 minutes, to give a 18 micrometers dry thickness second group strip layer control sample. If unrestrained, the prepared ground strip layer sample will spontaneously curl upwardly into a 1¾ inch roll.

Disclosure Ground Strip Layer I

Two ground strip layer samples of this disclosure was prepared by following the exact same procedures and using the same material compositions as those described in the CONTROL GROUND STRIP LAYER I, but with the exception that 5 and 10 weight percent of liquid diethyl phthalate (DEP) plasticizer were incorporated into each respective ground strip layer composition to reduce/eliminate internal stress/strain build-up in each layer sample for effective curl control/suppression The molecular structure of DEP, available from Sigma-Aldrich Corporation, is shown in Formula (II) below:

Formula (II)

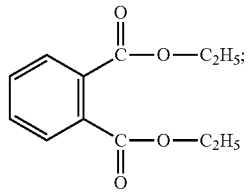

Disclosure Ground Strip Layer II

Two ground strip layer samples of this disclosure was prepared by following the exact same procedures and using the same material compositions as those described in the DISCLOSURE GROUND STRIP LAYER I, but with the exception that 5 and 10 weight percent of liquid diethylene glycol bis(allyl carbonate) plasticizer were incorporated into each respective ground strip layer composition to reduce/eliminate internal stress/strain build-up in each layer sample for effective curl control/suppression. The molecular structure of diethylene glycol bis(allyl carbonate), CR-39, available from PPG Industries, Inc., is shown in Formula (6) below:

Formula (6)

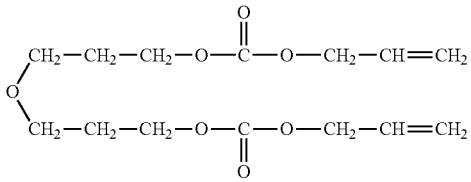

Disclosure Ground Strip Layer III

Two ground strip layer samples of this disclosure was prepared by following the exact same procedures and using the same material compositions as those described in the DISCLOSURE GROUND STRIP LAYER I, except that 5 and 10 weight percent of a monomeric bisphenol A carbonate liquid were incorporated into each respective ground strip layer composition to reduce/eliminate internal stress/strain build-up in each layer sample for effective curl control/suppression. The molecular structure of the bisphenol A carbonate liquid (HIRI), available from PPG Industries, Inc., is shown in Formula (1) below:

Formula (1)

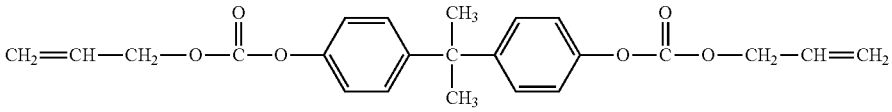

Control Ground Strip Layer II

Another conventional ground strip layer coating solution was also prepared by combing 30.56 grams of bisphenol A polycarbonate (FPC 0170), 12 grams XEDAG/KB carbon black, and 1.4 gram silica particles in 416 grams methylene chloride solvent. The coating solution was then applied over second 4.2-mil PEN substrate support, by following the standard hand coating procedures and dried at 130° C. in an air circulating oven for 2 minutes, to give a 18 micrometers dry thickness second group strip layer control sample. If unrestrained, the prepared ground strip layer sample will spontaneously curl upwardly into a 1¾ inch roll.

Disclosure Ground Strip Layer IV

Three ground strip layer samples of this disclosure was prepared by following the exact same procedures and using the same material compositions as those described in the GROUND STRIP LAYER CONTROL II, but with the exception that 5, 10, and 15 weight percent of liquid DEP plasticizer were incorporated into each respective ground strip layer composition to effect internal stress/strain build-up reduction/elimination in each layer sample and provide curl control/suppression.

Curl and Electrical Conductivity Assessments

The control ground strip layers I and II, disclosure ground strip layers I to IV were determined for each respective extent of sample curling-up and electrical resistivity (reciprocal to conductivity) integrity. The results thus obtained, listed in Table 1 below, show that all the plasticized ground strip layers (prepared using various plasticizers and according the material and methodology of the present disclosure) have, by comparison to each respective control counterpart, provided effective curl control outcome to render flatness without deleteriously impacting the crucial electrical conductivity of the layer.

TABLE 1

| Ground Strip ID | Curl Diameter (inches) | Resistivity (Ω/sq.)** |
|---|---|---|
| CONTROL I | 1.75 | 6,500 |
| Disclosure Embodiment: 5% DEP added | 22 | 6,800 |
| Disclosure Embodiment: 10% DEP added | Flat | 7,000 |
| Disclosure Embodiment:: 5% CR-39 added | 20 | 6,700 |
| Disclosure Embodiment: 10% CR-39 added | Flat | 6,950 |
| Disclosure Embodiment: 5% HIRI added | 20 | 6,650 |
| Disclosure Embodiment: 10% HIRI added | Flat | 7,000 |
| CONTROL II | 1.75 | 2,650 |
| Disclosure Embodiment: 5% DEP added | 26 | 3,520 |
| Disclosure Embodiment: 10% DEP added | Flat | 4,500 |
| Disclosure Embodiment: 15% DEP added | Flat | 5,100 |

**Note:
the ground strip layer resistivity spec. is 35,000 Ω/sq.

Control Imaging Member Preparation

A conventional flexible multilayered electrophotographic imaging member web was prepared by providing a 0.02 micrometer thick titanium layer coated substrate of a biaxially oriented polyethylene naphthalate (PEN, available as KADALEX from DuPont Teijin Films) having a thickness of 4.2 mils. The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a CGL. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web was simultaneously coated over with a charge transport layer (CTL) and an adjacent ground strip layer at the edge of the imaging member web by co-extrusion of the two coating solutions. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine.

The resulting mixture was dissolved to give 15 percent by weight solid in methylene chloride. This solution was applied on the CGL by extrusion to form a coating which after drying in a forced air oven gave a dry CTL 29 micrometers thick comprising 50:50 weight ratio of diamine transport charge transport compound to FPC0170 bisphenol A polycarbonate binder. The imaging member web, at this point if unrestrained, would curl upwardly into a 1¾-inch tube.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (FPC 0170, available from Mitsubishi Chemicals) having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web containing all of the above layers was then passed through 125° C. a forced air oven to dry the co-extrusion coated ground strip and CTL simultaneously to give respective 19 micrometers and 29 micrometers in dried thicknesses. At this point, the imaging member, having all the dried coating layers, would spontaneously curl upwardly into a 1¾-inch roll when unrestrained as the web was cooled down to room ambient of 25° C. Since the CTL, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the 29 micrometer thick CTL to result in imaging member upward curling. The prepared imaging member web, same as that shown in FIG. 1 but without the application of an ACBC, had a curl-up diameter of 1¾-inch curvature was used to serve as control.

Reference Imaging Member Preparation

A reference structurally simplified flexible multilayered electrophotographic imaging member web was also prepared by the following exact same procedures and identical material compositions as those described in the Control Imaging Member Preparation, but with the exception that 8 weight percent of DEP plasticizer was incorporated into the material matrix of the CTL to effect the suppression of internal stress/strain build-up in the layer for curl control. The resulting imaging member containing the DEP plasticized CTL, unlike the curling-up seen in the Control Imaging Member, had a substantially flat configuration without the application of an ACBC.

Disclosure Imaging Member Preparation

A structurally simplified flexible multilayered electrophotographic imaging member web of present disclosure was subsequently prepared by the exact same manners and identical material compositions as those described in the Reference Imaging Member Preparation, but with the exception that 8 weight percent of DEP plasticizer was incorporated into the material matrix of the CTL and also to its adjacent ground layer at one edge of the imaging member web to respectively eliminate the internal stress/strain from these layers. The prepared imaging member, having 8 weight percent plasticized CTL/ground strip layer, thus obtained had absolute flatness without application of an ACBC.

Dynamic Imaging Member Belt Machine Cycling Test

The structurally simplified flexible multilayered electrophotographic imaging member webs obtained according to the embodiments of the Reference Imaging Member and the structurally simplified flexible multilayered imaging member of Disclosure Imaging Member Preparation described above were cut into rectangular sheets of pre-determined dimensions. A pair of opposite ends of each imaging member cut sheet was then brought to overlap together thereof and joined by ultrasonic welding technique into each respective flexible seamed belt.

Both the Reference Imaging Member belt and the Disclosure Imaging Member belt were dynamically cycling tested in two separate and identical electrophotographic imaging machines. The result as observed was that the Reference Imaging Member belt, comprising the plasticized CTL, had shown slightly edge curling upward at the ground strip side of the belt; this did cause some belt cyclic motion disturbance as the dynamically tracking the edge guide of the belt support module. In contrast, the Disclosure Imaging Member belt, prepared to have plasticized CTL and plasticized ground strip layer, was absolutely flat in both the belt and the trans-belt directions to give excellent machine belt cyclic motion quality without edge guide tracking issue. The improved belt motion quality did impact toner imaging formation on the belt surface which thereby gave significant copy print out quality enhancement.

In recapitulation, structurally simplified flexible multilayered imaging member belt comprising plasticizer in both the CTL and the ground strip to effect the elimination of ACBC, as demonstrated in the embodiments of present disclosure, is the key to render internal stress/strain reduction in these two layers for achieving absolute curl control, and without negatively affecting the photo-electrical function of the resulting curl free imaging member.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents as would fall within the true scope and spirit of embodiments herein.

What is claimed is:

1. A flexible imaging member comprising:

a flexible substrate;

a charge generating layer disposed on the substrate;

at least one charge transport layer disposed on the charge generating layer; and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point.

2. The flexible imaging member of claim 1, wherein the charge transport compound is N,N'-diphenyl-N,N'-bis(3-methylphenyl)-1,1-biphenyl-4,4'-diamine.

3. The flexible imaging member of claim 1, wherein the ground strip layer further comprises a conductive species selected from the group consisting of carbon black, a graphite dispersion, and mixtures thereof.

4. The flexible imaging member of claim 1, wherein the plasticizing liquid compound is selected from the group consisting of liquid phthalates, liquid monomeric carbonates, oligomeric polystyrenes and fluoroketones.

5. The flexible imaging member of claim 4, wherein the liquid phthalates are selected from the group consisting of Formula (I)

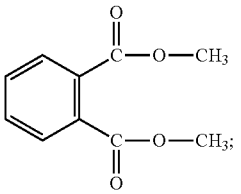

Formula (IA)

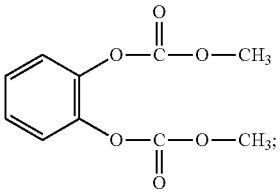

Formula (II)

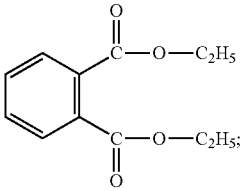

Formula (IIA)

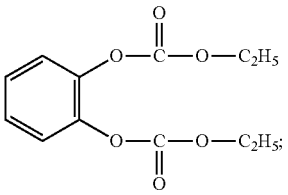

-continued

Formula (III)

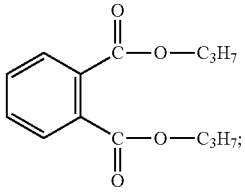

Formula (IV)

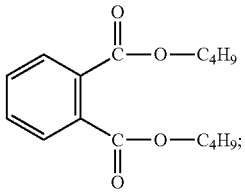

Formula (V)

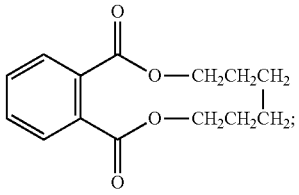

Formula (VI)

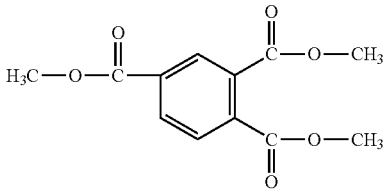

and

Formula (VII)

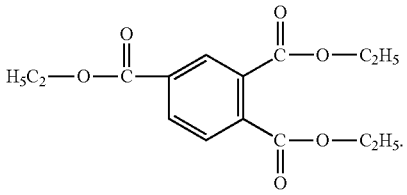

6. The flexible imaging member of claim 4, wherein the liquid monomeric carbonates are selected from the group consisting of Formula (1)

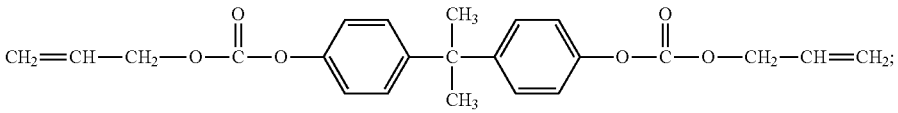

Formula (2)

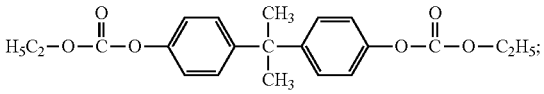

Formula (3)

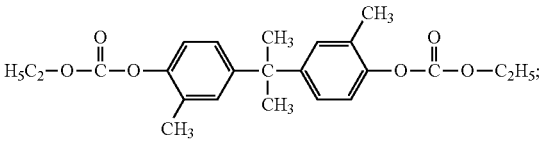

-continued

Formula (4)

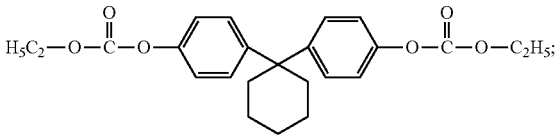

Formula (5)

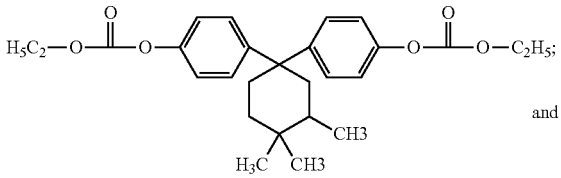

and

Formula (6)

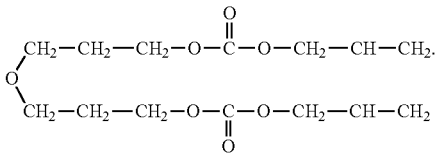

7. The flexible imaging member of claim 4, wherein the oligomeric polystyrenes are selected from the group consisting of Formula (A)

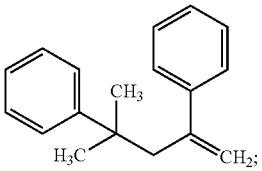

Formula (B)

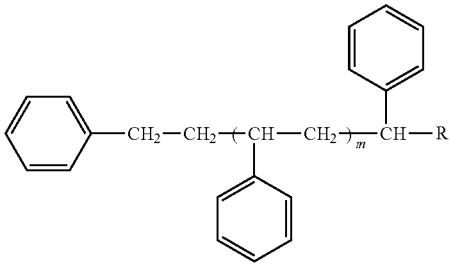

wherein R is selected from the group consisting of H, $CH_3$, $CH_2CH_3$, and $CH{=}CH_2$, and where m is between 0 and 3.

8. The flexible imaging member of claim 4, wherein the fluoroketones are selected from the group consisting of 3-(trifluoromethyl)phenylacetone, 2'-(trifluoromethyl)propiophenone, 2,2,2-trifluoro-2',4'-dimethoxyacetophenone, 3',5'-bis(trifluoromethyl)acetophenone, 3'-(trifluoromethyl)propiophenone, 4'-(trifluoromethyl)propiophenone, 4,4,4-trifluoro-1-phenyl-1,3-butanedione, and 4,4-difluoro-1-phenyl-1,3-butanedione, represented by the molecular structures shown below:

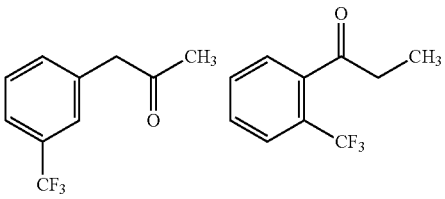

-continued

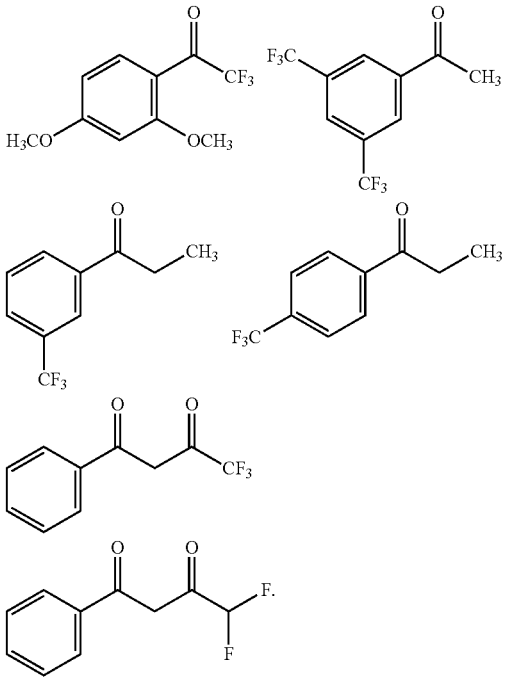

9. The flexible imaging member of claim 1, wherein liquid plasticizing compound is present in the charge transport layer and the ground strip layer in an amount of from about 3 to about 30 percent by weight of the total weight of the respective layer.

10. The flexible imaging member of claim 9, wherein liquid plasticizing compound is present in the charge transport layer and the ground strip layer in an amount of from about 5 to about 12 percent by weight of the total weight of the respective layer.

11. The flexible imaging member of claim 1, wherein the liquid plasticizing compound in the charge transport layer is the same liquid plasticizing compound in the ground strip layer.

12. The flexible imaging member of claim 1, wherein an amount of liquid plasticizing compound in the charge transport layer is the same amount of liquid plasticizing compound in the ground strip layer.

13. The flexible imaging member of claim 1, wherein the charge transport layer comprises from about 20 to about 80 weight percent of a film forming bisphenol A polycarbonate of poly(4,4'-isopropylidene diphenyl carbonate) binder and from about 80 to about 20 of a charge transport compound of N,N'-diphenyl-N,N'-bis(3-methylphenyl)-1,1'-biphenyl-4,4'-diamine, based on the combined weight of polycarbonate binder and charge transport compound.

14. The flexible imaging member of claim 1, wherein the ground strip layer comprises from about 65 to about 85 weight percent of film a forming bisphenol A polycarbonate of poly(4,4'-isopropylidene diphenyl carbonate) binder, from about 0.5 to about 3 weight percent of ethyl cellulose, from about 15 to about 25 weight percent of graphite, and from about 1 to about 5 weight percent of silica dispersion, based on the combined weight of polycarbonate, ethyl cellulose, graphite, and silica dispersion in the ground strip layer.

15. The flexible imaging member of claim 1, wherein the ground strip layer comprises from about 60 to about 80 weight percent of a film forming bisphenol A polycarbonate of poly(4,4'-isopropylidene diphenyl carbonate) binder, about 20 to about 40 weight percent of carbon black, and about 1 to about 5 weight percent of silica dispersion, based on the combined weight of polycarbonate, carbon black, and silica dispersion in the ground strip layer.

16. The flexible imaging member of claim 1, wherein the liquid plasticizing compound has a boiling point of at least 250° C.

17. A flexible imaging member comprising:

a flexible substrate;

a charge generating layer disposed on the substrate;

at least one charge transport layer disposed on the charge generating layer;

and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point, and further wherein the liquid plasticizing compound is selected from the group consisting of diethyl phthalate, diethylene glycol bis(allyl carbonate), monomeric bisphenol A carbonate, and mixtures thereof.

18. The flexible imaging member of claim 17, wherein the charge transport layer comprises the liquid plasticizing compound in an amount of from about 3 to about 30 or from about 5 to about 12 percent by weight of the total weight of the charge transport layer.

19. The flexible imaging member of claim 17, wherein the ground strip layer comprises the liquid plasticizing compound in an amount of from about 3 to about 30 or from about 5 to about 12 percent by weight of the total weight of the ground strip layer.

20. The flexible imaging member of claim 17, wherein the liquid plasticizing compound in the charge transport layer is the same liquid plasticizing compound in the ground strip layer.

21. The flexible imaging member of claim 17, wherein an amount of liquid plasticizing compound in the charge transport layer is the same amount of liquid plasticizing compound in the ground strip layer.

22. An image forming apparatus for forming images on a recording medium comprising:

a) a flexible imaging member having a charge retentive-surface for receiving an electrostatic latent image thereon, wherein the flexible imaging member comprises a flexible substrate;

a charge generating layer disposed on the substrate;

at least one charge transport layer disposed on the charge generating layer; and a ground strip layer disposed adjacent to the charge transport layer and at an edge of the imaging member, wherein the charge transport layer comprises a film forming polycarbonate binder, a charge transport compound and a plasticizing liquid compound having a high boiling point, and the ground strip layer comprises a film forming polymer, a carbon black or a graphite dispersion, a silica particle dispersion, and a plasticizing liquid compound having a high boiling point;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *